US008099840B2

(12) United States Patent
Reutter et al.

(10) Patent No.: US 8,099,840 B2
(45) Date of Patent: Jan. 24, 2012

(54) DEVICE FOR NEEDLING A WEB OF FIBER

(75) Inventors: Tilman Reutter, Eidenberg (AT); Andreas Plump, Linz (AT); Andreas Mayer, Linz (AT); Daniel Bu, Ansfelden (AT)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 12/920,778

(22) PCT Filed: Mar. 2, 2009

(86) PCT No.: PCT/EP2009/052467

§ 371 (c)(1),
(2), (4) Date: Nov. 11, 2010

(87) PCT Pub. No.: WO2009/109553

PCT Pub. Date: Sep. 11, 2009

(65) Prior Publication Data

US 2011/0047767 A1 Mar. 3, 2011

(30) Foreign Application Priority Data

Mar. 3, 2008 (DE) ..... 10 2008 012 294
May 2, 2008 (DE) ..... 10 2008 021 958

(51) Int. Cl.
*D04H 18/00* (2006.01)

(52) U.S. Cl. ..... 28/114

(58) Field of Classification Search ..... 28/114, 28/107, 113, 108–112, 115; 112/80.42, 80.41
See application file for complete search history.

(56) References Cited

U.S. PATENT DOCUMENTS

| | | | | |
|---|---|---|---|---|
| 5,732,453 | A | 3/1998 | Dilo et al. | |
| 6,000,112 | A * | 12/1999 | Ollinger et al. | 28/107 |
| 6,266,856 | B1 * | 7/2001 | Fehrer et al. | 28/107 |
| 6,785,940 | B1 * | 9/2004 | Muller | 28/114 |
| 7,194,790 | B2 * | 3/2007 | Leger | 28/114 |

(Continued)

FOREIGN PATENT DOCUMENTS

AT 412 162 10/2004

(Continued)

OTHER PUBLICATIONS

International Search Report for International Application No. PCT/EP2009/052467.

(Continued)

*Primary Examiner* — Amy Vanatta
(74) *Attorney, Agent, or Firm* — Alston & Bird LLP

(57) ABSTRACT

The invention relates to a device for needling a web of fiber, said device comprising at least one driven needle beam. A vertical reciprocal movement of the needle beam is carried out by a vertical drive unit and a superposed horizontal reciprocal movement is carried out by a horizontal drive unit or due to a phase adjustment by the vertical drive unit. A weight balancing device is provided for balancing the inertia forces of the crank mechanisms. In order to be able to balance both vertical and horizontal inertia forces in a simple manner, the weight balancing device is formed by at least one balance weight which is associated with the crank mechanism of the vertical drive unit and which is set-off by an angle in the range of <180° from an eccentric element of the crank mechanism.

14 Claims, 7 Drawing Sheets

U.S. PATENT DOCUMENTS

| | | | | |
|---|---|---|---|---|
| 7,308,744 | B2 * | 12/2007 | Mikota | 28/107 |
| 2006/0288549 | A1 * | 12/2006 | Jean et al. | 28/107 |
| 2007/0006432 | A1 * | 1/2007 | Noel et al. | 28/107 |
| 2009/0119894 | A1 * | 5/2009 | Reutter et al. | 28/114 |

FOREIGN PATENT DOCUMENTS

| | | |
|---|---|---|
| GB | 1 257 669 | 12/1971 |
| GB | 1 288 935 | 9/1972 |

OTHER PUBLICATIONS

International Preliminary Report on Patentability for International Application No. PCT/EP2009/052467.

* cited by examiner

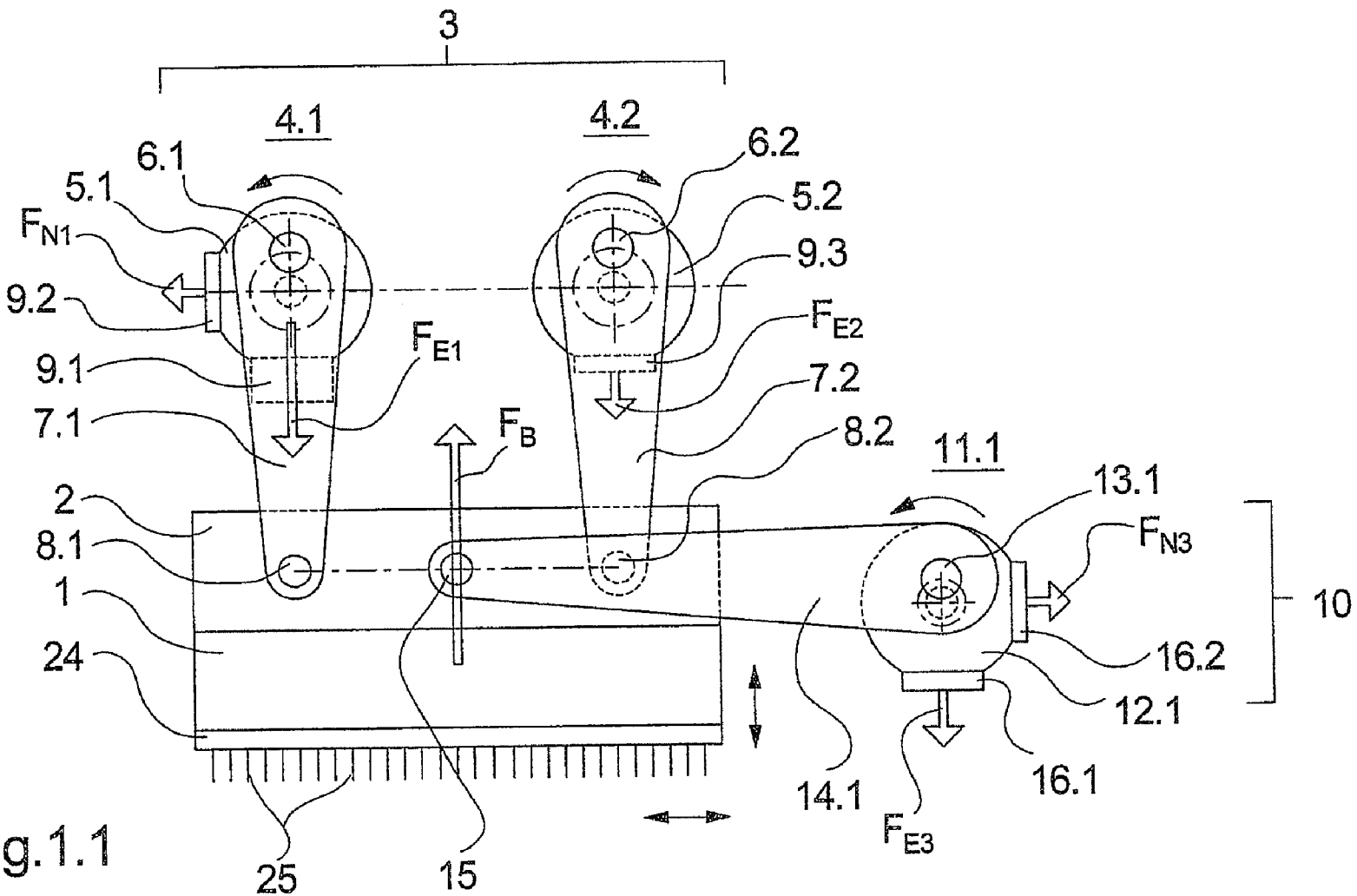
Fig. 1.1

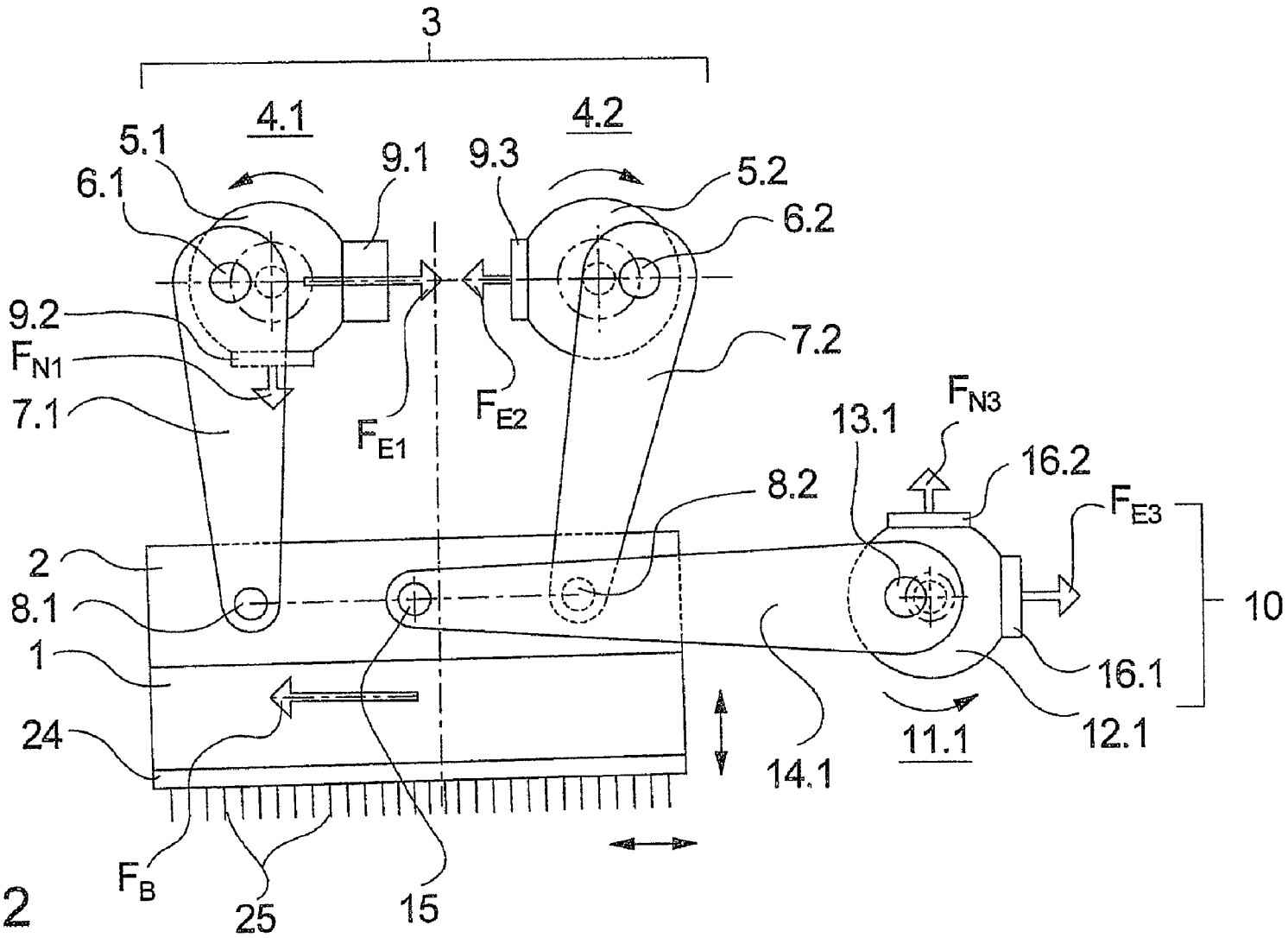
Fig. 1.2

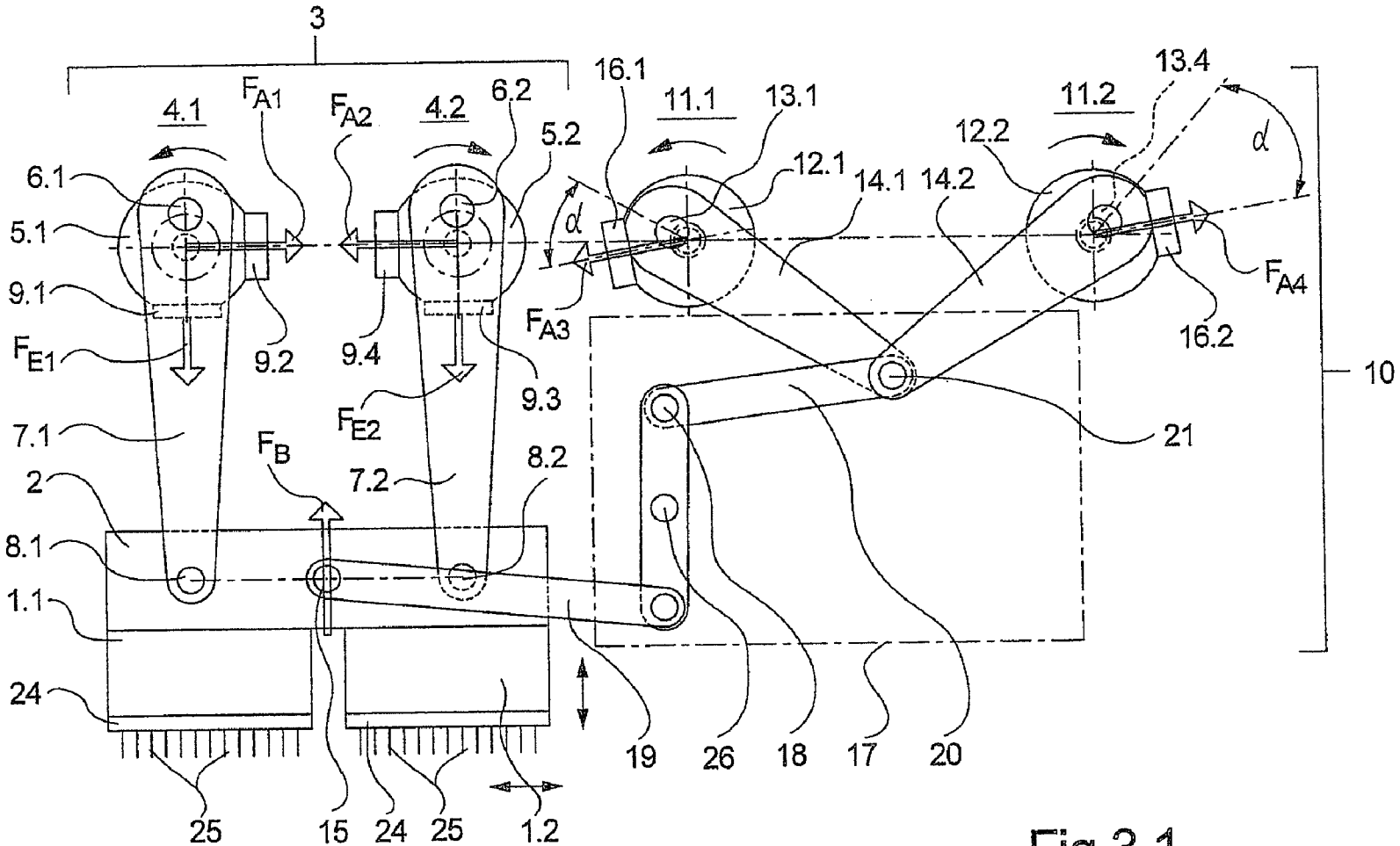
Fig.3.1

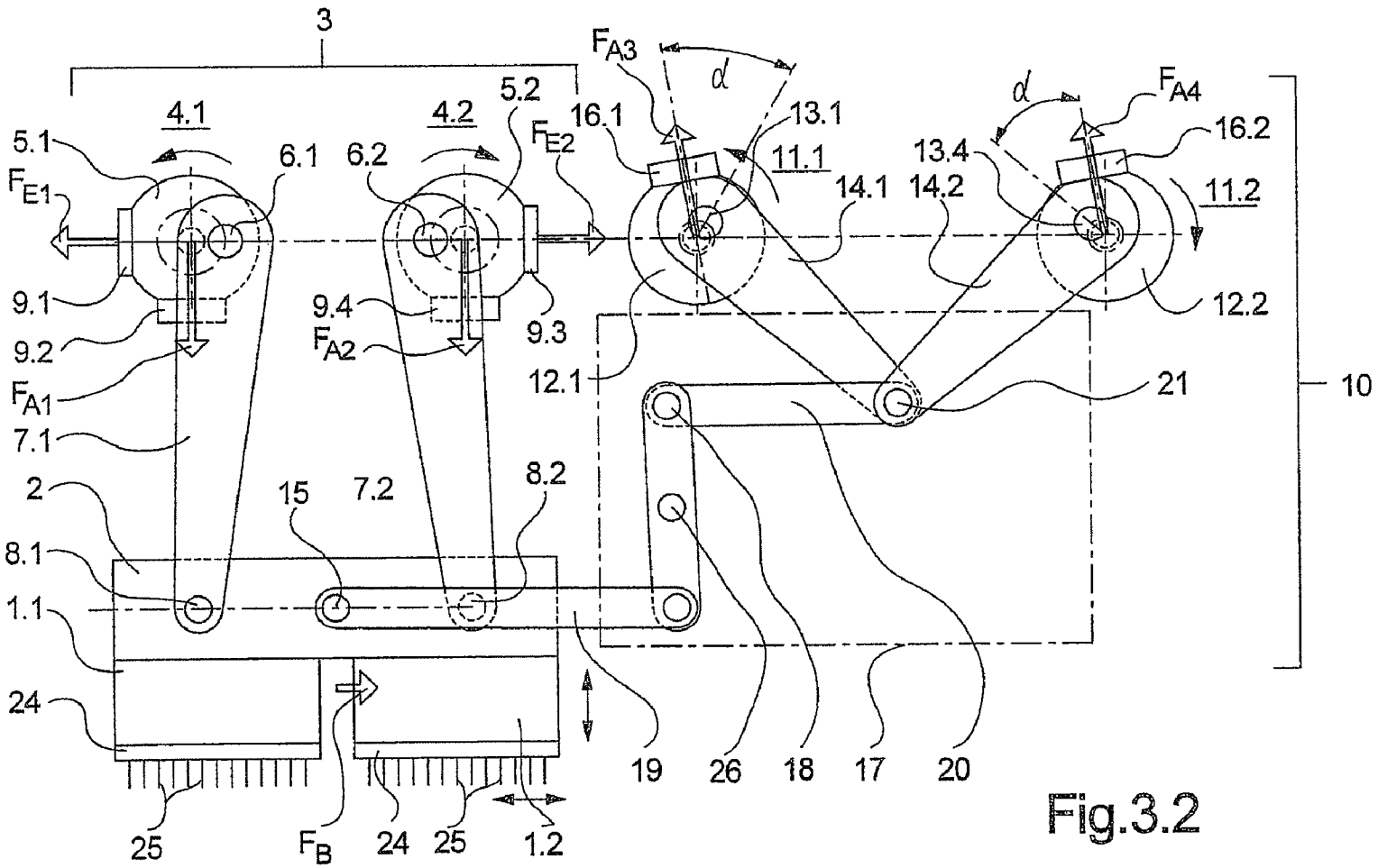
Fig.3.2

DEVICE FOR NEEDLING A WEB OF FIBER

BACKGROUND OF THE INVENTION

1. Field of the Invention

The invention concerns a device for needling of a fiber web.

2. Description of Related Art

In devices for needling of a fiber web, a needle beam, on whose bottom a number of needles are held, is driven in an oscillating up-and-down movement, so that the needles repeatedly perforate the fiber web guided on a substrate. Crank mechanisms are ordinarily used to drive such needle beams, in which an eccentrically rotating eccentric weight for weight balancing is ordinarily compensated by corresponding balancing weights on the crankshaft. The inertial effects, because of the rotating and oscillating weight within the device, can be kept low, so that no inadmissible vibrations in the machine frame occur. In order to achieve higher production speeds during needling of a fiber web, drive concepts of the needle beam are now known, in which a superimposed back-and-forth movement of the needle beam aligned in the horizontal direction is generated relative to the up-and-down movement. Such a device is known, for example, from DE 196 15 697 A1.

In the known device, the needle beam is driven by a vertical drive mechanism in an up-and-down movement and by a horizontal drive mechanism in a superimposed back-and-forth movement. The inertial forces in the device occur both in the vertical direction and in the horizontal direction. To balance the weight and inertia, several balancing shafts are arranged in the known device in the machine frame, which counteract the weight and inertia of the crank mechanisms by oppositely rotating eccentric masses. This form of balancing is technically very demanding and requires significant space requirements within the device. The free weight forces and inertial forces occurring with variable stroke adjustment of the horizontal drive mechanism are particularly problematical, since they increase quadratically with stroke frequency and linearly with stroke height. Higher stroke frequencies and therefore higher production speeds, as well as greater horizontal strokes of the needle beam in the known device, therefore necessarily lead to increased vibrations in the machine frame. Such vibrations, however, are very negative with respect to noise, and especially with respect to product quality.

The task of the invention is therefore to design a device for needling of a fiber web of the generic type, so that balancing of the inertial forces occurring in the vertical and horizontal direction is possible by simple means.

Another objective of the invention is to provide a device of the generic type that permits variable stroke adjustments of the needle beam with relatively large horizontal strokes and high stroke frequencies.

SUMMARY OF VARIOUS EMBODIMENTS

This task is solved according to the invention by a device with the features described herein.

Advantageous modifications of the invention are also defined by the features and feature combinations described herein.

The invention is separated from the principle of compensating for inertial forces acting on a crank mechanism by a counterweight, which is arranged in an eccentric plane opposite the eccentric weight. The invention is based on the finding that the crank mechanism of the vertical drive mechanism can be used to counteract the horizontally directed inertial forces, in addition to the vertically directed inertial forces. For this purpose, a balancing weight of the weight balancing device is assigned to the crank mechanism of the vertical drive mechanism and offset by an angle in the range <180° relative to an eccentric of the crank mechanism. The size of the balancing weight and the angular position of the balancing weight on the crank mechanism can be chosen as a function of the weight forces and the inertial forces acting in the vertical and horizontal directions. Balancing functions can therefore be implemented on the existing crank mechanisms, which would otherwise be achieved only by additional balancing shafts or other demanding measures. The balancing weight for this purpose is arranged directly on a crankshaft or an eccentric shaft of the crank mechanism. In this case, it is unessential whether the superimposed horizontal movement of the needle beam is produced by a horizontal drive mechanism or during phase adjustment directly by the vertical drive mechanism. In each case, the occurring horizontal inertial forces can be balanced by the balancing weight on the crank mechanism of the vertical drive mechanism.

In a particularly preferred modification of the invention, the balancing weight is offset by an angle of 90° to the eccentric of the crank mechanism and a second balancing weight is offset by an angle of 180° to the eccentric of the crank mechanism. The vertical inertial forces of the needle beam on the crank mechanism can therefore be fully compensated. The balancing weight, arranged offset by 90° to the eccentric weight of the crank mechanism, is then opposite the horizontal inertial forces. At constant horizontal stroke of the needle beam, complete weight balancing can be implemented. The needle beam can be operated with correspondingly high stroke frequencies, without inadmissible vibrations becoming active on the machine frame.

The balancing weights assigned to a crank mechanism can be the same or different in size. The choice of size of the balancing weight is essentially dependent on the inertial forces occurring during operation.

In order to achieve parallel guiding of the needle beam within a machine frame, the vertical drive mechanism is preferably formed by two synchronously running drive mechanisms. In this case, according to an advantageous modification of the invention, one or more balancing weights is assigned to each crank mechanism. Each crank mechanism can therefore be used for weight balancing of the vertical and horizontal inertial forces. The balancing weights on the crank mechanisms of the vertical drive mechanism can be designed identical or different on each of the crank mechanisms. For example, one of the crank mechanisms can be equipped with two balancing weights, whereas the second crank mechanism receives only one balancing weight.

In particularly complex drive concepts of the needle beam, the balancing device can also be expanded, in that an additional balancing shaft is arranged within the machine frame with a rotating eccentric weight. The inertia within the machine frame, in particular, can be fully compensated by this. Depending on the drive concept, the balancing shaft can be equipped with a rotating eccentric weight or with two rotating eccentric weights offset by 90°.

For a case, in which the horizontal movement is produced by phase adjustment of the vertical drive mechanism, the phase adjustment device preferably has two separately controllable servo motors assigned to the crankshafts of the crank mechanisms of the vertical drive mechanism. Depending on the phase difference between the crankshafts, strokes of different height can then be implemented in the horizontal movement. For weight and inertial balancing, the balancing shaft is preferably arranged symmetric to the two crankshafts of the crank mechanisms.

In order to be able to directly compensate the inertial forces acting in the horizontal drive mechanism with a separate drive mechanism of the horizontal drive mechanism, according to an advantageous modification of the invention, at least one additional balancing weight is assigned to the crank mechanism of the horizontal drive mechanism and arranged offset by an angle in the range <180° to the eccentric of the crank mechanism.

However, as an alternative, there is also the possibility to choose the arrangement of balancing weights on the crank mechanism of the horizontal drive mechanism, so that the balancing weight is offset by 90° relative to the eccentric and a second balancing weight is arranged opposite the eccentric weight.

In order to achieve the most flexible possible horizontal drive of the needle beam, the horizontal drive mechanism is preferably formed by two synchronously running crank mechanisms. In this case, at least one of the balancing weights is advantageously assigned to each of the crank mechanisms.

In order to permit variable stroke adjustment, the crank mechanisms of the horizontal drive mechanism can be driven oppositely and their phase positions designed adjustable. Through the balancing weights assigned to the crank mechanisms, variable inertial forces can be compensated, in addition to the constant inertial forces. With appropriate choice of balancing weights, the resulting inertial force therefore disappears approximately for each horizontal stroke adjustment between zero and a maximum stroke.

In order to obtain the most stable possible guiding of the drive movement of the needle beam, the crank mechanisms and horizontal drive mechanism are preferably connected to the needle beam by a coupling mechanism. The drive movement of the crank mechanisms can thus be converted by the coupling mechanisms into an almost exclusive grade movement on the needle beam.

The crank mechanisms of the vertical drive mechanism and the horizontal drive mechanism are ordinarily designed by means of a driven crankshaft or driven eccentric shaft, which are connected to a connecting rod via a connecting rod small end.

To balance the inertial forces, the balancing weights are mounted directly on the crankshaft or on the eccentric shaft.

BRIEF DESCRIPTION OF THE SEVERAL VIEWS OF THE DRAWINGS

The device according to the invention is further explained below by means of the practical example with reference to the accompanying figures.

In the figures:

FIGS. 1.1 and 1.2 schematically depict a side view of a first practical example of the device according to the invention FIG. 2 schematically depicts a side view of a practical example of a crank mechanism with weight balancing FIGS. 3.1 and 3.2 schematically depict a side view of another practical example of the device according to the invention FIG. 4 schematically depicts a side view of another practical example of the device according to the invention FIG. 5 schematically depicts a side view of another practical example of the device according to the invention

DETAILED DESCRIPTION

Figure 2:
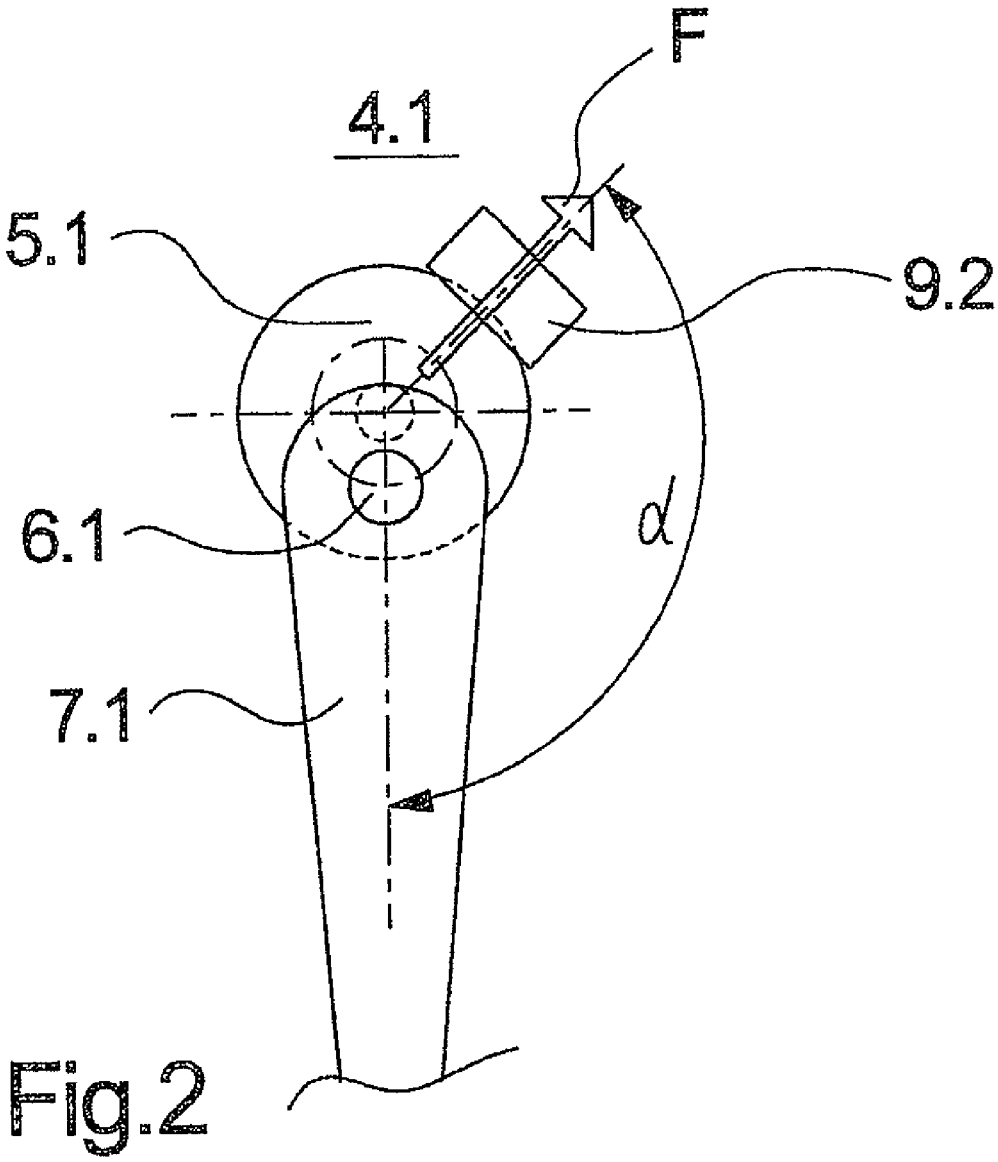

In FIGS. 1.1 and 1.2, a first practical example of the device according to the invention for needling of a fiber web is shown. The practical example is shown in different operating situations in FIGS. 1.1 and 1.2. The description therefore applies to both figures. The practical example of the device according to the invention has a beam support 2, which holds a needle beam 1 on the bottom. The needle beam 1 holds a needle board 24 on its bottom with a number of needles 25.

A vertical drive mechanism 3 and a horizontal drive mechanism 10 engage on the beam support 2. The beam support 2 is moved oscillating in the vertical direction via the vertical drive mechanism 3, so that the needle beam 1, with needle board 24, executes an up-and-down movement. The vertical drive mechanism 3 is formed by two parallel crank mechanisms 4.1 and 4.2. The crank mechanisms 4.1 and 4.2 have two parallel crankshafts 5.1 and 5.2 arranged above the beam support 2. The crankshafts 5.1 and 5.2 each have at least one eccentric 6.1 and 6.2 to accommodate a connecting rod 7.1 and 7.2.

The connecting rods 7.1 and 7.2 arranged on the beam support 2 are shown in FIG. 1, which are held with their connecting rod small ends on the eccentrics 6.1 and 6.2 of the crankshafts 5.1 and 5.2. Additional (not shown here) connecting rods can be arranged on crankshafts 5.1 and 5.2.

The connecting rods 7.1 and 7.2 are connected with their free ends to the beam support 2 via pivot joints 8.1 and 8.2. The crankshafts 5.1 and 5.2 are driven synchronously in the same or opposite direction, so that the beam support 2 is guided at least roughly parallel.

For superimposed horizontal movement of needle beam 1, the horizontal drive mechanism 10 engages via a crank mechanism 11.1 directly on the beam support 2. The crank mechanism 11.1 of the horizontal drive mechanism 10 has a crankshaft 12.1 and a connecting rod 14.1 for this purpose. The connecting rod 14.1 is connected via an eccentric 13.1 to crankshaft 12.1. On the free end, the connecting rod 14.1 is coupled to the beam support 2 via a pivot joint 15. The crankshaft 12.1 is driven synchronously to the crankshafts 5.1 and 5.2 of the vertical drive mechanism, so that the needle beam 1 executes a lifting movement with a constant horizontal stroke.

A weight balancing device to balance the inertial forces of the crank mechanisms is assigned to the vertical drive mechanism 3 in the horizontal drive mechanism 10. The weight balancing device here is formed by several balancing weights assigned to the crank mechanisms 4.1, 4.2 and 5.1. The crank mechanism 4.1 has balancing weights 9.1 and 9.2. The balancing weight 9.1 is arranged offset by an angle of 180° to the eccentric 6.1 on crankshaft 5.1. The balancing weight 9.2 is offset by an angle of 90° to the eccentric 6.1 on crankshaft 5.1.

A third balancing weight 9.3 is arranged as counterweight on crankshaft 4.2. For this purpose, the balancing weight 9.3 is offset by an angle of 180° to the eccentric 6.2 on crankshaft 5.2.

The balancing weights 16.1 and 16.2 are assigned to the crankshaft 11.1 of the horizontal drive mechanism 10. The balancing weight 16.1 is offset by an angle of 180° to the eccentric 13.1 on crankshaft 12.1. The other balancing weight 16.2 is offset by an angle of 90° to the eccentric 13.1 on the crankshaft 12.1.

To further explain the weight balancing device, the practical example in FIG. 1.1 is shown in an operating situation, in which the needle beam is shown in its upper position with vertically directed inertial forces. The practical example in FIG. 1.2, on the other hand, is shown in a middle beam position, in which horizontal inertial forces are active.

In the situations depicted in FIG. 1.1, the inertial forces generated by the balancing weights 9.1, 9.2, 9.3, 16.1 and 16.2 are shown as vectors. The force vector of the balancing weight 9.1 is marked with the code letters $F_{E1}$. The inertial force of the balancing weight 9.2 on crank mechanism 4.1 is accordingly marked by the letters $F_{N1}$. Similarly, the force vector of the balancing weight 9.3 assigned to crank mechanism 4.2 is marked with the letters $F_{E2}$. The balancing weights 16.1 and 16.2 assigned to the crank mechanism 11.1 of the horizontal drive mechanism 10 are marked by the letters $F_{N3}$ and $F_{E3}$ and as force vectors.

In the operating positions depicted in FIGS. 1.1 and 1.2, the inertial force $F_B$ engaging on the needle beam is compensated by the forces $F_{E1}+F_{E2}+F_{E3}$ of the balancing weights 9.1, 9.2 and 9.3 of the crank mechanisms 4.1 and 4.2. In the depicted operating positions, the inertial forces $F_{N1}$ and $F_{N3}$ of the balancing weights 9.2 and 16.2 are opposite. It is therefore possible to balance the horizontal and vertical inertial force with the balancing weights 9.1, 9.2 and 9.3. The balancing weights 9.2 and 16.2, which produce the inertial forces $F_{N1}$ and $F_{N3}$, are now chosen, so that they mutually cancel out in each position of the needle beam and produce an inertia to compensate for the inertia caused by the action line distance between the beam forces and balancing forces.

In the practical examples depicted in FIGS. 1.1 and 1.2, there are essentially two possibilities for mounting the balancing weights on the corresponding crank mechanisms. Another possible arrangement of a balancing weight is shown in FIG. 2, as can be performed as an alternative on the crank mechanism 4.1 of the vertical drive mechanism 3 of the crank mechanism 11.1 of the horizontal drive mechanism 10. For this purpose, a balancing weight 9.2 is assigned to the crank mechanism 4.1. The balancing weight 9.2 is offset by an angle a to the eccentric 6.1 of the crankshaft 5.1. The angle a is <180° and is preferably chosen so that both horizontally acting and vertically acting forces can be compensated by the balancing weight 9.2. The number of balancing weights can therefore be reduced with an equivalent effect.

Another practical example of the device according to the invention is schematically depicted in FIGS. 3.1 and 3.2 in a side view in several operating positions. The practical example according to FIGS. 3.1 and 3.2 is essentially identical to the practical example according to FIGS. 1.1 and 1.2, so that only the differences are explained here and otherwise reference is made to the aforementioned description. The practical example in FIG. 3.1 is shown in an upper position of the needle beam and FIG. 3.2 in a middle position of the needle beam.

In the practical example depicted in FIGS. 3.1 and 3.2, two needle beams 1.1 and 1.2 are held on the beam supports 2, each of which carries a needle board 24 and a number of needles 25 on their bottoms. The beam support 2 is connected to a vertical drive mechanism 3, designed identical to the aforementioned practical example. For horizontal movement of the beam support 2, the beam support 2 is connected to a linkage 19 via a pivot joint 15. In this practical example, the pivot joint 15 is arranged essentially with the pivot joints 8.1 and 8.2 to connect the vertical drive mechanism 3 at a common height on beam support 2, so that the linkages 19 arranged relative to the transverse sides of the beam support 2 permit force introduction and guiding of the beam support 2.

For deflection of linkage 19, a horizontal drive mechanism 10 is provided, which is formed by two crank mechanisms 11.1 and 11.2. The crank mechanisms 11.1 and 11.2 each have a crankshaft 12.1 and 12.2 arranged parallel to each other and, together with crankshafts 5.1 and 5.2 of vertical drive mechanism 3, form a common drive plane. The crankshafts 12.1 and 12.2 are each connected to a connecting rod 14.1 and 14.2 via their eccentrics 13.1 and 13.2. The connecting rods 14.1 and 14.2 are directed toward each other with an oblique position, so that the free ends of the connecting rods 14.1 and 14.2 are connected together to a coupling mechanism 17 via a double pivot joint 21.

The coupling mechanism 17 in this practical example consists of a toggle lever 18, which is mounted to pivot on a pivot bearing 26. The toggle lever 18 has a pivot joint on the free end beneath pivot bearing 26, with which the linkage 19 is connected to toggle lever 18. Another pivot joint is provided on the opposite free end of toggle lever 18, on which a push rod 20 engages. The push rod 20 is connected to connecting rods 14.1 and 14.2 with an opposite end through double pivot joint 21.

The crankshafts 12.1 and 12.2 of the crank mechanisms 11.1 and 11.2 are driven oppositely with the same speed, in which the phase positions of the crankshafts 12.1 and 12.2 are adjustable relative to each other as a function of a desired horizontal stroke. The phase positions and therefore the desired horizontal stroke of crankshafts 12.1 and 12.2 can be accomplished, for example, by two separate servo motors that produce a rotation of crankshafts 12.1 and 12.2 relative to each other. Drive of crankshafts 14.1 and 14.2 can be accomplished by a common drive or separately by separate drives.

To compensate for inertial forces on the crank mechanisms 4.1, 4.2, 11.1 and 11.2, a balancing device is provided, which is formed by several balancing weights assigned to the crank mechanisms. Each of the crank mechanisms 4.1 and 4.2 of the vertical drive mechanism 3 has two balancing weights. A first balancing weight is arranged as counterweight on the crank mechanisms 4.1 and 4.2 and offset by an angle of 180° relative to eccentrics 6.1 and 6.2 of crankshafts 5.1 and 5.2. The balancing weights are designed with the reference number 9.1 on the crank mechanism 4.1 and 9.3 on the crank mechanism 4.2. A second balancing weight is offset by 90° relative to eccentrics 6.1 and 6.2 on crankshafts 5.1 and 5.2. The balancing weights 9.2 and 9.4 of crank mechanisms 4.1 and 4.2 are then designed greater in weight than the balancing weights 9.1 and 9.3.

The crank mechanisms 11.1 and 11.2 of the horizontal drive mechanism 10 each have a balancing weight 16.1 and 16.2. The balancing weight 16.1 on crank mechanism 11.1 is offset at an angle <180° relative to eccentric 13.1 and crankshaft 12.1. The angle a that designates the offset between the eccentric 13.1 and the balancing weight 16.1 on the crankshaft 12.1 is about 20° in this practical example. The position of the balancing weight 16.1, and also the position of the balancing weight 16.2 are essentially determined by the arrangement on the crank mechanisms 11.1 and 11.2 relative to each other. The connecting rods 14.1 and 14.2 are arranged in an oblique position and connected to each other via the double pivot joint 21. The balancing weight 16.2 on crank mechanism 11.2 is therefore in the same position and with the same size on crank mechanism 11.2.

To drive the needle beams 1.1 and 1.2, both the crank mechanisms 4.1 and 4.2 of the vertical drive mechanism 3 and the crank mechanisms 11.1 and 11.2 of the horizontal drive mechanism 10 are driven synchronously and oppositely. A situation is shown in FIG. 3.1, in which the beam support 2 is held at top dead center with the needle beams 1.1 and 1.2. FIG. 3.2 shows the practical example in the operating situation, in which the beam support 2, with the needle beams 1.1 and 1.2, is in the middle position during execution of a horizontal movement. The inertial forces assigned to the balancing weights 9.1 to 9.4 and the balancing weights 16.1 and 16.2 are designated with the letters $F_A$ and $F_B$.

The four balancing forces $F_{A1}$ to $F_{A4}$ of the balancing weights 9.2, 9.4, 16.1 and 16.2 are compensated in the dead positions of beam support 2, as is apparent from FIG. 3.1. The inertial forces $F_{E1}$ and $F_{E2}$, caused by the balancing weights 9.1 to 9.4, all run counter to the inertial force $F_B$ engaging on beam support 2. Because of the oblique position of the force components, a resulting inertial force remains between the dead positions. With appropriate choice of balancing weights 9.2, 9.4, 16.1 and 16.2, the horizontal inertial force of the beam support with these force components with needle beams 1.1 and 1.2 is compensated in the horizontal direction. In the vertical direction, the balancing force is changed, especially at low adjustment angles and therefore oblique positions of the force components only slightly, so that force balancing for each horizontal stroke up to a maximum adjustment angle of about 20° is retained in very good approximation, as follows from the situation in FIG. 3.2.

However, it is also possible to design balancing for an adjustment angle that is different from zero. This means that the balancing weights on the crank mechanisms 11.1 and 11.2 of the horizontal drive mechanism 10 are mounted rotated by the angle a, so that the corresponding balancing forces are vertical at a corresponding adjustment angle. This means that the useful adjustment angle can be doubled without noticeable deviations occurring in vertical force balancing. The balancing weights 9.1 to 9.4 and the crank mechanisms 4.1 and 4.2 of the vertical drive mechanism 3 are adjusted in this case, so that for the region of horizontal stroke, the inertial forces are balanced in the vertical and horizontal direction.

In order to compensate for any form of free inertias occurring in addition to balancing of the inertial forces, the variant of the device according to the invention depicted in FIGS. 3.1 and 3.2 can be made with a balancing device, in which a balancing shaft with a rotating concentric weight is provided, in addition to the balancing weights. This type of practical example is depicted in FIG. 4.

Figure 4:
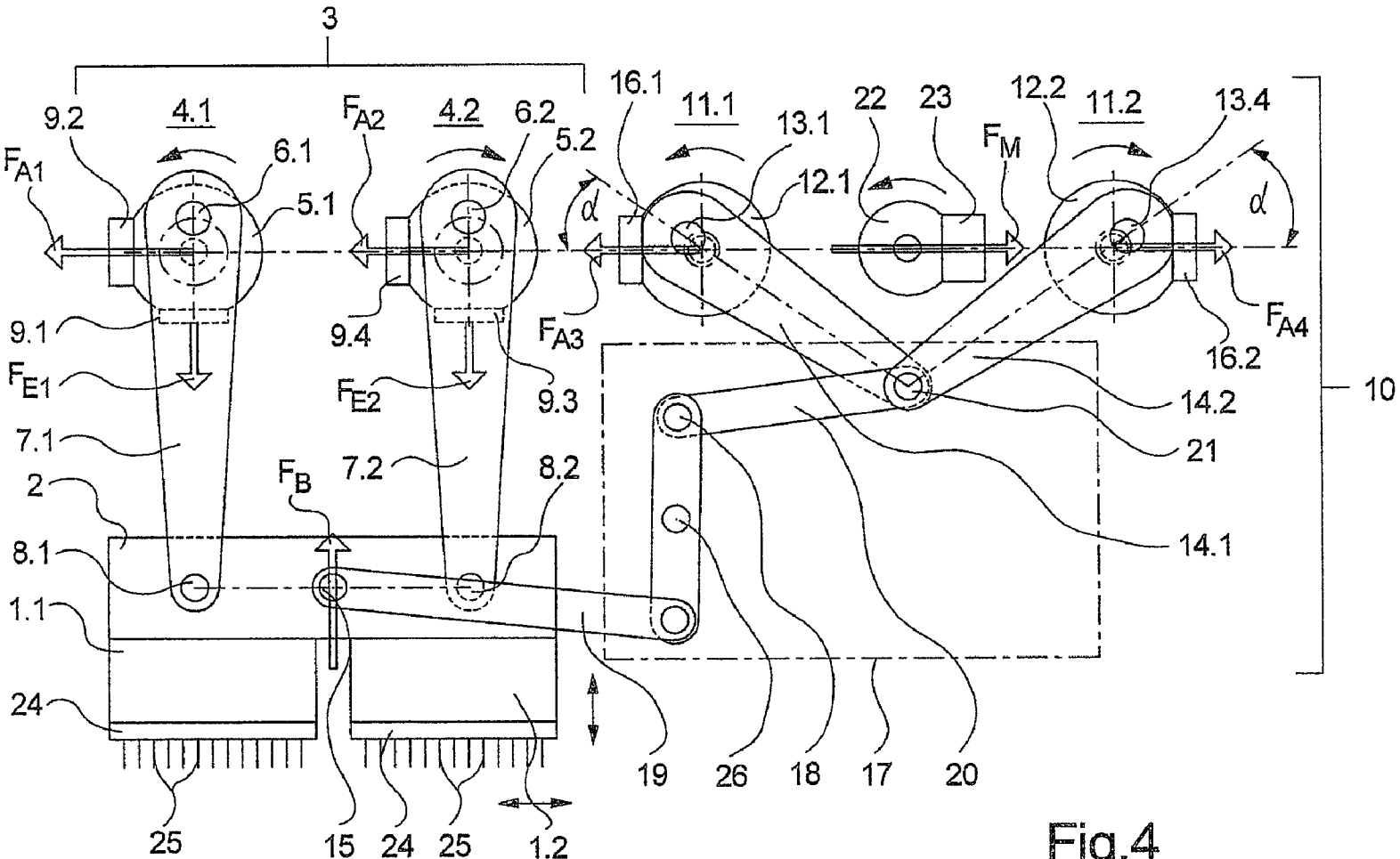

The practical example according to FIG. 4 is identical to the practical example according to FIG. 3.1, except for the balancing device. To this extent, the previous description is referred to and only the differences are explained.

For weight balancing, the balancing device has several balancing weights, as well as a balancing shaft with rotating eccentric weight. The balancing shaft 22 is arranged in the drive plane between the crank mechanisms 11.1 and 11.2 of the horizontal drive mechanism 10. The balancing shaft 22 extends parallel to the crankshafts 12.1 and 12.2 lying in the drive plane, which are also parallel to the crankshafts 5.1 and 5.2 of the vertical drive mechanism 3 arranged in the same plane. An eccentric weight 23 is arranged on the balancing shaft 22. The balancing shaft 22 is driven synchronously with the crankshafts 12.1 and 12.2 of the crank mechanisms 11.1 and 11.2, in which the balancing shaft 22 and the crankshaft 12.1 have the same direction of rotation.

For weight balancing, the balancing weights 16.1 and 16.2 are arranged on the crankshafts 12.1 and 12.2 of the crank mechanisms 11.1 and 11.2. The arrangement is then identical to the previously described practical example according to FIG. 3.1.

The crank mechanisms 4.1 and 4.2 of the vertical drive mechanisms 3 are also assigned to balancing weights in offset arrangement. The balancing weights 9.1 and 9.2 are assigned to the crank mechanism 4.1 and the balancing weights 9.3 and 9.4 to the crank mechanism 4.2. The balancing weights 9.1 to 9.4 of the crank mechanisms 4.1 and 4.2 are different in size. The balancing weight 9.2 arranged essentially to balance the horizontal inertial forces on the crank mechanism 4.1 is smaller than the balancing weight 9.4 on the second crank mechanism 4.2 of the vertical drive mechanism 3.

Overall, in the situation depicted in FIG. 4, force equilibrium is produced between the forces generated by the balancing weights. The inertial force $F_M$ of the eccentric weight 23 acts in the same direction as the inertial force $F_{A4}$ of the balancing weight 16.2 on the crank mechanism 11.2. The inertial forces $F_M$ and $F_{A4}$ are opposite the inertial forces $F_{A1}$, $F_{A2}$ and $F_{A3}$. The vertical inertial force $F_B$ acting on the beam support 2 is balanced by the balancing weights 9.1 to 9.4 arranged on the crank mechanisms 4.1 and 4.2 and their inertial forces $F_{E1}$ and $F_{E2}$.

Figure 5:
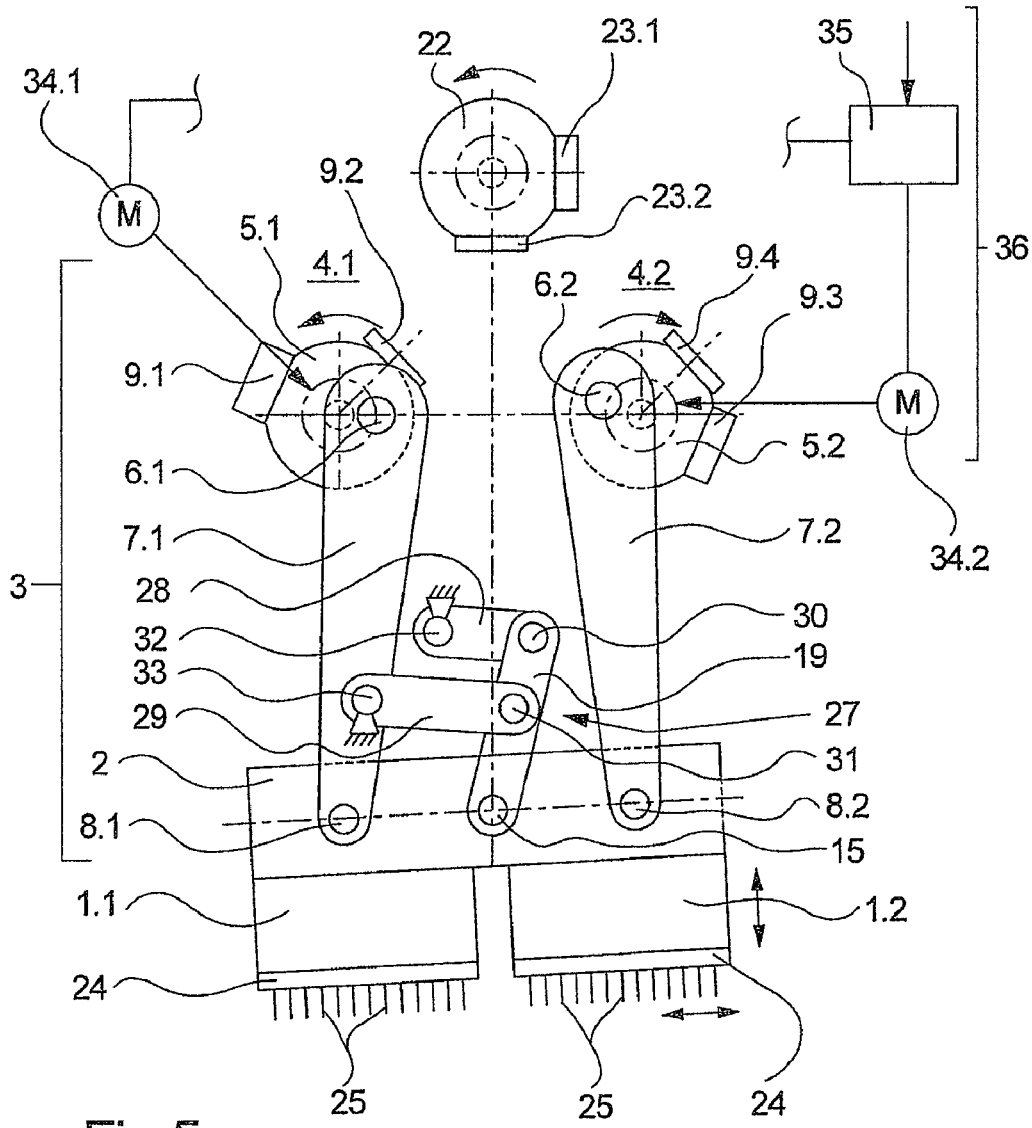

Another practical example of the device for needling of a fiber web is schematically depicted in FIG. 5 in a side view. The practical example according to FIG. 5 differs essentially from the aforementioned practical examples in that no separate or horizontal drive mechanisms present degenerate an overlapping horizontal movement of the needle beam. In the practical example depicted in FIG. 5 of the device according to the invention, the superimposed horizontal movement of the needle beam is introduced via the vertical drive mechanism 3.

For this purpose, the vertical drive mechanism connected to the beam support 2 has two parallel arranged crank mechanisms 4.1 and 4.2. The crank mechanisms 4.1 and 4.2 have two parallel arranged crankshafts 5.1 and 5.2, which are arranged above the beam support 2. The crankshafts 5.1 and 5.2 each have at least one eccentric section to accommodate at least one connecting rod. The connecting rods 7.1 and 7.2 arranged on a beam support 2 are shown in FIG. 5, which are guided with their connecting rod small ends on the crankshafts 5.1 and 5.2.

The crankshafts 5.1 and 5.2 are assigned a phase adjustment device 36. The phase adjustment device 36 has two servo motors 34.1 and 34.2 assigned to the crankshafts 5.1 and 5.2. The servo motors 34.1 and 34.2 are connected to a control device 35. The servo motors 34.1 and 34.2 can be activated independently of each other by the control device 35, in order to rotate the crankshafts 5.1 and 5.2 into their positions. The phase position between the two crankshafts 5.1 and 5.2 can therefore be adjusted. In addition to the pure vertical up-and-down movement of the beam support 2, a superimposed horizontal movement can therefore be executed on the beam support 2. During offset of the phase position of crankshafts 5.1 and 5.2, an oblique position is introduced to the beam support 2 via the connecting rods 7.1 and 7.2, which produces, during continuing movement, a movement component directed in the movement direction of a fiber web. The size of the phase adjustment between the crankshafts 5.1 and 5.2 is directly proportional to a stroke length of the horizontal movement. The stroke of the horizontal movement can therefore be adjusted via the phase angle of the crankshafts 5.1 and 5.2.

In the situation depicted in FIG. 5, a phase difference is adjusted between crankshafts 5.1 and 5.2, so that the beam support 2, with needle beams 1.1 and 1.2, executes a constant stroke in the horizontal direction.

To guide the beam support 2, a guide device 27 is provided. The guide device has a linkage 19, which is connected with one free end to the beam support 2 via a pivot joint 15. On the opposite end of the linkage, a first rocker arm 28 engages, which is connected via a pivot bearing 32 to a machine frame and to the linkage via a pivot joint 30. A second rocker arm 29 is provided at a spacing from the first rocker arm 28, which is held in the middle area of the linkage 19 via a pivot joint 31 and via a pivot bearing 33.

The guide device 27 is arranged above the beam support 2. The pivot bearings 32 and 33 are arranged between the connecting rods 7.1 and 7.2. The linkage 19 is connected in the beam center to the beam support via the pivot joint 15. Secure guiding of the beam support during the drive movement by the vertical drive mechanism 3 can therefore be achieved.

The balancing device assigned to the crank mechanisms 4.1 and 4.2 is formed in this practical example by a total of four balancing weights 9.1, 9.2, 9.3 and 9.4. The balancing weights 9.1 and 9.2 are assigned to the crankshaft 5.1. The balancing weights 9.3 and 9.4 are fastened to the crankshaft 5.2. The balancing weight 9.1 is offset on crankshaft 5.1 by an angle of 180° relative to eccentric 6.1. The balancing weight 9.2 is offset by an angle of 90° relative to the first balancing weight 9.1 on crankshaft 5.1.

The balancing weight 9.3 in the crank mechanism 4.2 is offset by 180° relative to the eccentric 6.2 on the crankshaft 5.2. The balancing weight 9.4 is offset by an angle of 90° relative to the first balancing weight 9.3 on the crankshaft 5.2. Both the vertical and horizontal inertial forces of the crank mechanisms 4.1 and 4.2 can therefore be advantageously balanced by the balancing weights 9.1 to 9.4.

In order to achieve full balancing of the weighed and inertial forces, in particular, the balancing device additionally has a balancing shaft 22, which is arranged around the crankshafts 5.1 and 5.2. The balancing shaft 22 is held symmetric to the crank mechanisms 4.1 and 4.2. Two eccentric weights 23.1 and 23.2 are arranged on the balancing shaft 22. The balancing shaft 22 extends parallel to the crankshafts 5.1 and 5.2 and is driven synchronously with the crankshafts 5.1 and 5.2. The direction of rotation of the balancing shaft 22 in the direction of rotation of the crankshafts 5.1 and 5.2 is marked by an arrow in FIG. 5.

The function for balancing of the inertial forces in operation of the device depicted in FIG. 5 is identical to the aforementioned practical example, so that no further explanation occurs here.

The invention extends not only to the practical examples of a device for needling of a fiber web depicted in FIGS. 1, 3 and 4, but can also advantageously be used on other drive mechanism concepts, in which a needle beam is guided with constant horizontal stroke over variable horizontal strokes. The invention is particularly advantageous in those devices, in which the stroke adjustment of the horizontal stroke occurs by rotation of two eccentric shafts relative to each other. It is explicitly pointed out here that the invention is not restricted to the fact that crank mechanisms are driven by crankshafts. In principle, the crankshafts could be replaced without problem by eccentric shafts.

The invention claimed is:

1. A device for needling of a fiber web, said device comprising:

at least one driven needle beam with a vertical drive mechanism for oscillating movement of the needle beam in a vertical up-and-down movement;

a horizontal drive mechanism or a phase adjustment device assigned to the vertical drive mechanism for execution of a superimposed oscillating movement of the needle beam in a horizontal back-and-forth movement, in which the vertical drive mechanism has separate crank mechanisms; and a balancing device to balance the inertial forces of the crank mechanisms, wherein the balancing device is formed by at least one balancing weight assigned to one of the crank mechanisms of the vertical drive mechanism and offset at an angle ($\alpha$) in the range less than 180° to an eccentric of the crank mechanism.

2. The device according to claim 1, wherein the balancing weight is offset by an angle of 90° relative to the eccentric of the crank mechanism, and wherein a second balancing weight is offset by an angle of 180° to the eccentric of the crank mechanism.

3. The device according to claim 2, wherein the two balancing weights are equally large or unequally large.

4. The device according to claim 1, wherein the vertical drive mechanism is formed by two synchronously running crank mechanisms, and wherein the balancing device is formed by several balancing weights assigned to the two crank mechanisms.

5. The device according to claim 3, wherein the eccentric of the crank mechanisms of the vertical drive mechanism are assigned at least one of the balancing weights.

6. The device according to claim 1, wherein the balancing device has an additional balancing shaft with a rotating eccentric weight or with two rotating eccentric weights offset by 90° relative to each other.

7. The device according to claim 1, wherein the phase adjustment device has two servo motors assigned to the crankshafts of the crank mechanisms, and wherein the balancing shaft is arranged symmetric to the crankshafts.

8. The device according to claim 1, wherein the horizontal drive mechanism has at least one separate crank mechanism, and wherein at least one additional balancing weight is provided, which is assigned to the crank mechanism of the horizontal drive mechanism, and which is offset by an angle in the range less than 180° to an eccentric of the crank mechanism of the horizontal drive mechanism.

9. The device according to claim 8, wherein the additional balancing weight is offset by an angle of 90° to the eccentric of the crank mechanism of the horizontal drive mechanism, and wherein a second balancing weight is offset by an angle of 180° to the eccentric of the crank mechanism of the horizontal drive mechanism.

10. The device according to claim 8, wherein the horizontal drive mechanism is formed by two synchronously running crank mechanisms, and wherein at least one balancing weight is assigned to each of the crank mechanisms of the horizontal drive mechanism.

11. The device according to claim 10, wherein the crank mechanisms of the horizontal drive mechanism are driven oppositely, and wherein the phase positions of the two crank mechanisms of the horizontal drive mechanism are designed adjustable to set a stroke.

12. The device according to claim 10, wherein the horizontal drive mechanism has a coupling mechanism that forms a connection between the crank mechanisms of the horizontal drive mechanism and the needle beam.

13. The device according to claim 1, wherein the crank mechanisms each have a driven crankshaft or eccentric shaft and connecting rods connected to the crankshaft or eccentric shaft via a connecting rod small end.

14. The device according to claim 13, wherein the balancing weight or the balancing weights are arranged on the crankshaft or eccentric shaft.

* * * * *